US005642839A

United States Patent [19]

Lee

[11] Patent Number: 5,642,839

[45] Date of Patent: Jul. 1, 1997

[54] SQUEEZING HOLDER FOR A TUBE

[76] Inventor: Wan Ki Lee, 11722 Westshore Ct., Cupertino, Calif. 95104

[21] Appl. No.: 667,829

[22] Filed: Jun. 20, 1996

[51] Int. Cl.[6] ..... B65D 35/34

[52] U.S. Cl. ..... 222/99

[58] Field of Search ..... 222/95, 97–105

[56] References Cited

U.S. PATENT DOCUMENTS

| | | | |
|---|---|---|---|
| 648,981 | 5/1900 | Nelson . | |
| 1,986,409 | 1/1935 | Redmer | 222/99 |
| 2,670,875 | 3/1954 | Perlmutter . | |
| 3,885,708 | 5/1975 | Parry . | |
| 4,570,828 | 2/1986 | Wood . | |
| 4,576,314 | 3/1986 | Elias et al. . | |
| 5,097,987 | 3/1992 | Liberatore . | |
| 5,102,014 | 4/1992 | Yanagisawa et al. . | |
| 5,215,223 | 6/1993 | Lee . | |
| 5,263,610 | 11/1993 | Okamura et al. . | |

FOREIGN PATENT DOCUMENTS

| | | | |
|---|---|---|---|
| 715390 | 11/1963 | Canada | 222/100 |
| 590713 | 4/1959 | Italy . | |

*Primary Examiner*—Philippe Derakshani
*Attorney, Agent, or Firm*—Keck, Mahin & Cate

[57] ABSTRACT

A holder for squeezing a soft tube, includes a main housing having a longitudinal slot and a hollow cylindrical interior, a center tube gripper having a longitudinal slot for receiving a closed end of a soft tube and being received by the main housing, a cover being assembled with the main housing at one end of the housing and having a plurality of fixed teeth, the cover receiving a key section of the center tube gripper, and a rotating device for rotating the center tube gripper so that a soft tube inserted into the longitudinal slot of the center tube gripper is wound up, and thereby flattened. The wound portion of the soft tube is stored inside the main housing. The rotating device further includes a rotation handle for manually rotating the center tube gripper, the rotation handle receiving the key section of said center tube gripper. A one-way-rotation disc is placed inside the cover, having a plurality of flexible teeth, and receiving the key section of the center tube gripper, wherein the plurality of flexible teeth are deflected and slide over the plurality of fixed teeth of the cover to allow the center tube gripper to be rotated in one direction. The flexible teeth are not deflected in the other direction in order to prevent the center tube gripper from unwinding.

11 Claims, 6 Drawing Sheets

SQUEEZING HOLDER FOR A TUBE

BACKGROUND OF THE INVENTION

1. Field of the Invention

The present invention relates to a squeezing holder for a tube. More particularly, the invention relates to a squeezing holder for holding a soft tube container, enabling efficient use of gel or paste-like material in a soft tube container that needs to be flattened or squeezed in order to dispense the material in the tube, so that the contents in the tube can be efficiently used with minimum material left in the tube.

2. Description of Related Art

Up to this date, there are not many devices used for the same purpose as intended for this invention. Manual operation is the most commonly used method to squeeze material out of a tube, but that usually cannot use the contents in the tube completely efficiently and conveniently.

U.S. Pat. No. 4,576,314 relates to a device comprising jaws for squeezing and winding a collapsible tube containing, for example, toothpaste. This patent discloses an embodiment including a ratchet portion formed on a slotted key which cooperates with a pawl portion cut from the wall of the tubular portion of the body to prevent the key from unwinding.

U.S. Pat. No. 4,570,828 relates to a finger manipulated dispenser comprised of a core and a spool, both having longitudinal slots, wherein the smaller diameter core at the non-flanged end is partially cut to create a directional control pawl and wherein the spool at the larger diameter flange is notched at several radial locations to receive the directional control pawl, thereby completing a ratchet subassembly. Both enlarged flanged ends have finger gripping surfaces.

U.S. Pat. No. 5,097,987 patent relates to a dispenser for the contents of a collapsible tube comprising a cylinder and reel provided with knurled knobs. The reel has resilient tabs that engage shoulders on the cylinder to retain the reel in the cylinder.

U.S. Pat. No. 5,263,610 patent discloses, inter alia, a squeezing tool comprising friction means disposed on at least one of the spool and bearing portions to prevent the spool from rotating in the opposite direction relative to the bearing portions.

U.S. Pat. No. 5,102,014 patent relates to a tube squeezing device wherein relative rotation between an inner cylinder and an outer cylinder is prevented by a lock lever.

SUMMARY OF THE INVENTION

Accordingly, the present invention is directed to a squeezing holder for a tube that substantially obviates one or more of the problems due to the limitations and disadvantages of the related art.

A primary object of the present invention is to provide a squeezing holder for a tube that can be used to efficiently squeeze out the paste-like material from the tube and minimize the material remaining inside the tube.

Another object of the present invention is to provide a squeezing holder for a tube that enables a tube squeezing operation to be easily accomplished with one hand of the user and thus leaves the other hand of the user free.

Another object is to provide a design that can be manufactured in different sizes to accommodate different sizes of soft tube container.

Another object is to provide a convenient storage stand that can hold the tube while it is not used, and that can be easily reused when needed.

Another object is to provide a convenient squeezing holder for a tube that has a transparent body which enables the user to easily identify the label on the tube inside the holder.

Another object is to provide a squeezing holder that can be easily disassembled and reassembled for cleaning or other purposes.

Another object is to provide a tube squeezing holder that is simple in design and economical in cost and manufacture.

Further objects of the invention will be apparent from the description below.

To achieve these and other advantages and in accordance with the purpose of the invention, as embodied and broadly described, the invention provides a tube holder for squeezing a soft tube. The tube holder includes a main housing having a longitudinal slot and a hollow cylindrical interior; a center tube gripper having a longitudinal slot for receiving a closed end of a soft tube and being received by the main housing; a cover being assembled with the main housing at one end of the housing and having a plurality of fixed teeth, the cover receiving a key section of the center tube gripper; and a rotating device for rotating the center tube gripper so that a soft tube inserted into the longitudinal slot of the center tube gripper is wound up, and a thereby flattened, wound portion of the soft tube is stored inside the main housing. The rotating device further includes a rotation handle for manually rotating the center tube gripper, the rotation handle receiving the key section of said center tube gripper; and one-way-rotation disc being placed inside the cover, having a plurality of flexible teeth, and receiving the key section of the center tube gripper, wherein the plurality of flexible teeth are deflected and slide over the plurality of fixed teeth of the cover to allow the center tube gripper to be rotated in one direction and are not deflected in the other direction in order to prevent the center tube gripper from unwinding.

BRIEF DESCRIPTION OF THE DRAWINGS

To accomplish the above and related objects, this invention may be embodied in the form illustrated in the accompanying drawings which are illustrative only, and changes may be made in the specific construction illustrated and described within the scope of the appended claims.

FIG. 3A shows how the tube is installed in the squeezing holder. FIG. 3B illustrates the material being squeezed out of the tube according to the first embodiment of the present invention. FIG. 3C illustrates an enlarged detail of FIG. 3B.

DETAILED DESCRIPTION OF THE PREFERRED EMBODIMENTS

Reference will now be made in detail to the present preferred embodiments of the invention, examples of which are illustrated in the accompanying drawings.

Figure 1:
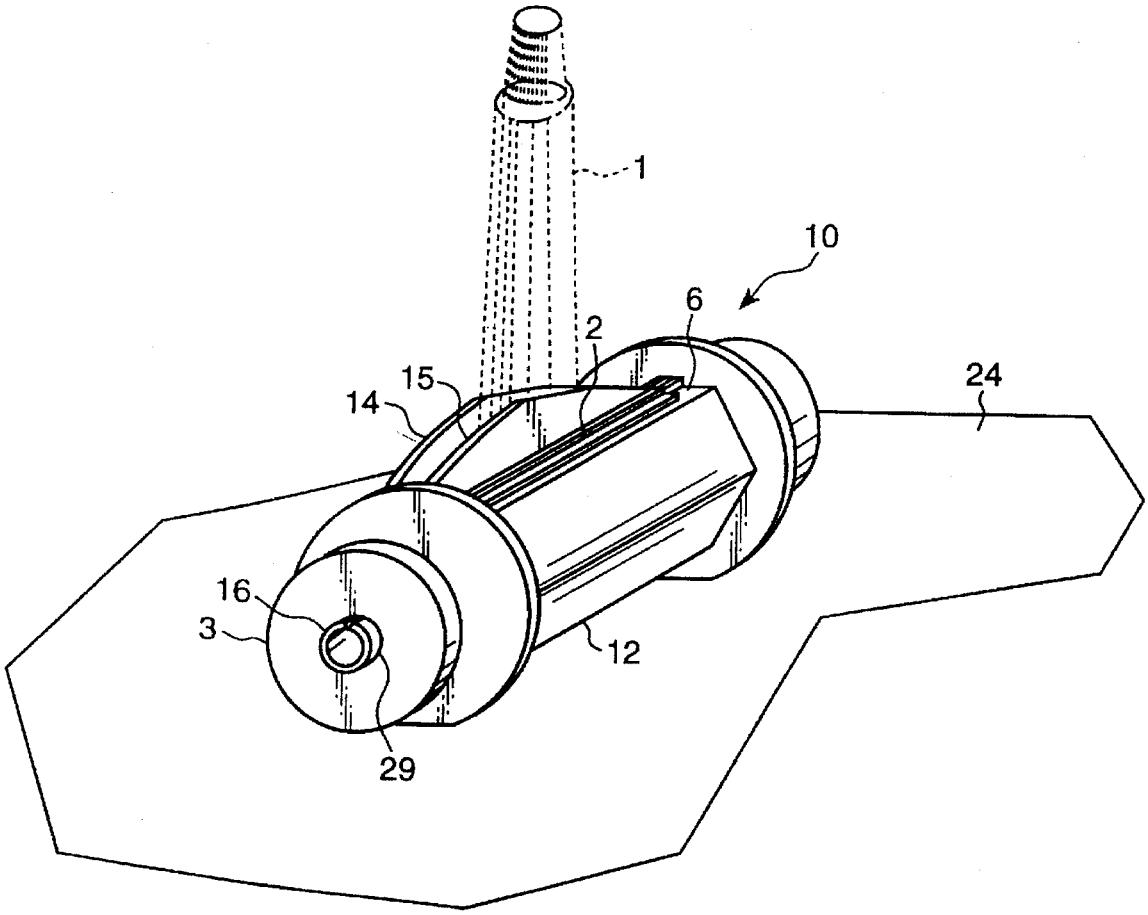
FIG. 1 is a perspective view illustrating a tube inserted into a squeezing holder for a tube according to a first embodiment of the present invention.

An exemplary embodiment of the squeezing holder for a tube of the present invention is shown in FIG. 1 and is designated generally by reference numeral 10. FIG. 1 illustrates a tube 1, shown in broken lines, inserted into a squeezing holder 10 according to the present invention. As illustrated in FIG. 1, a main housing 12 of holder 10 has a hexagon shaped exterior, a hollow cylindrical interior 13, better seen in FIGS. 3A and 3B, and a longitudinal slot 2. The main housing 12 is preferably made of transparent material so that a user can identity the label on a tube 1 easily. Two flanges 14 and 15, also preferably of transparent material, are attached along the slot 2 on flat side 6 of the main housing 12. The edge 7 along the slot 2 may be thickened to strengthen the body of the main housing 12, as shown in FIG. 3C. End cap 3 is preferably attached to the main housing 12, although the end cap 3 may be a separate body.

Figure 2:
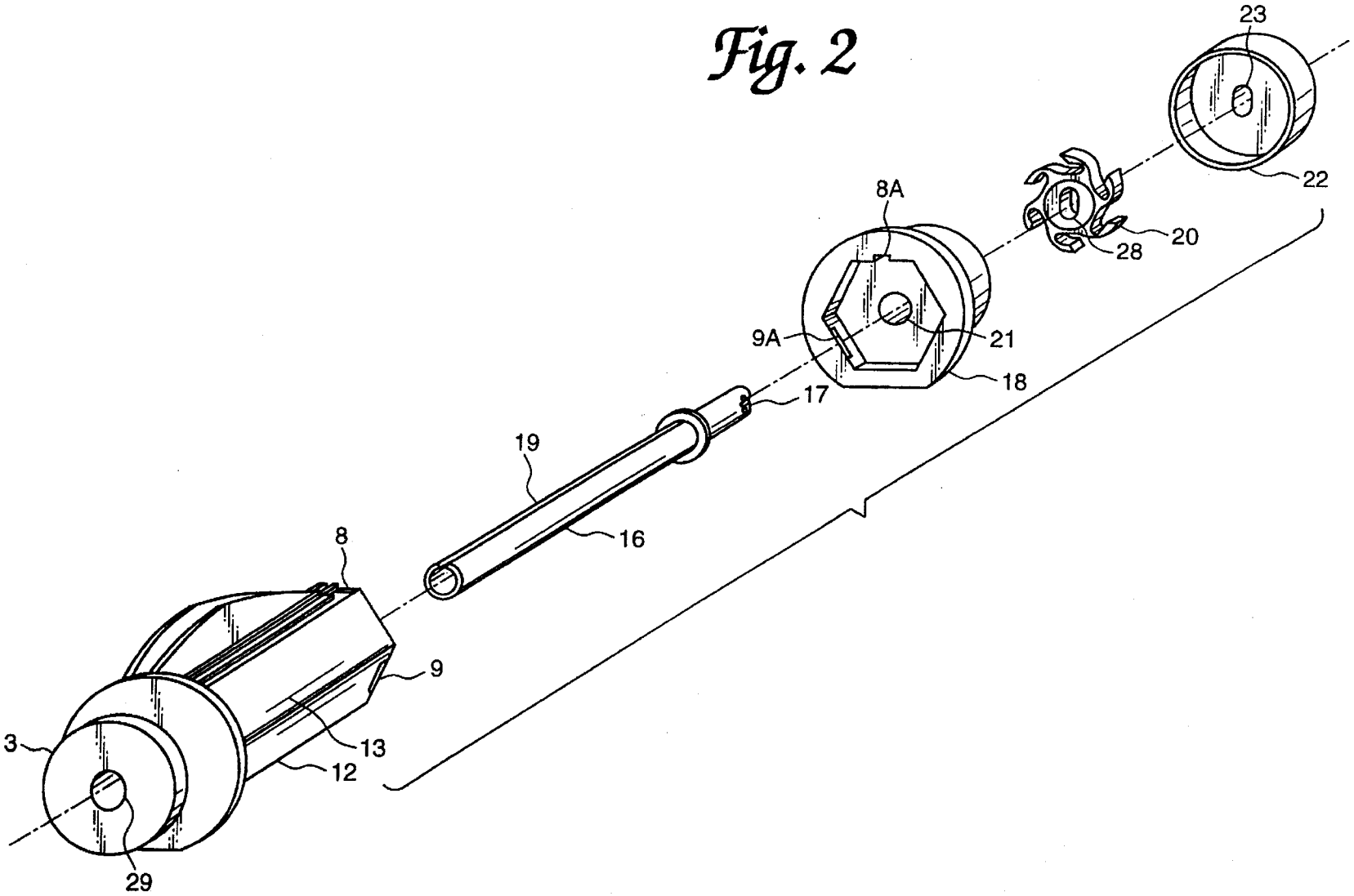
FIG. 2 is an exploded view showing separate parts of the squeezing holder for a tube arranged in relative assembled position according to the first embodiment of the present invention.

FIG. 2 illustrates separate parts of the invention arranged in relative assembled position according to the sequence of their assembly. The center tube gripper 16 is a cylindrical tube with a longitudinal slot 19. The center tube gripper 16 has a diameter less than the inside diameter of the cylindrical interior 13 of the main housing 12. The center tube gripper 16 is received orthogonally by the main housing 12. The end cap 3 has a center aperture 29 for receiving a first end of the center tube gripper 16, thereby stabilizing the center tube gripper 16 between the end cap 3 and a rotation handle 22. The second end of the center tube gripper 16 has a shaped key section 17. The key section 17 is orthogonally received through an open hole 21 of a cover 18 and key-shaped hole 28 of one-way-rotation disc 20, which is installed in cover 18. The key section 17 is further orthogonally received by a key-shaped hole 23 of a rotation handle 22. The key section 17 received into the shaped hole 23 of the rotation handle 22 is used to transfer rotational movement produced by a user turning the rotational handle 22 to the center tube gripper 16, thereby winding the flattened tube 1 into the main housing 12.

End cap 3 has at least one flat side to prevent the squeezing holder 10 from rolling when placed on a table 24 or other flat surface. Similarly, the cover 18 has at least one flat side to establish balance with the end cap 3, thereby preventing the squeezing holder 10 from rolling.

The cover 18 has a thick body construction. At the recessed face which is secured onto the hexagon-shaped main housing 12, the cover 18 is locked with the main housing 12, so that the cover 18 is prevented from any rotational movement caused by turning the rotation handle 22. Protrusions 9 are formed on the surface of the main housing 12, which engage with complementary notches 9A formed at the recessed face of the cover 18 to firmly secure the cover 18 with the main housing 12. Similarly, a rib 8 is formed at the end of the flat side 6, which engages with a complementary notch 8A. At the other face, the cover 18 includes a recessed surface to house the one-way-rotation disc 20 (See FIG. 9).

The outside of the rotation handle 22 has a knurled surface which provides a friction surface so that a user can easily turn the rotation handle 22 to apply rotational movement for turning the center tube gripper 16 and the one-way-rotation disc 20, thus winding in the empty, flattened portion of the tube 1 for storage.

Figure 3A:
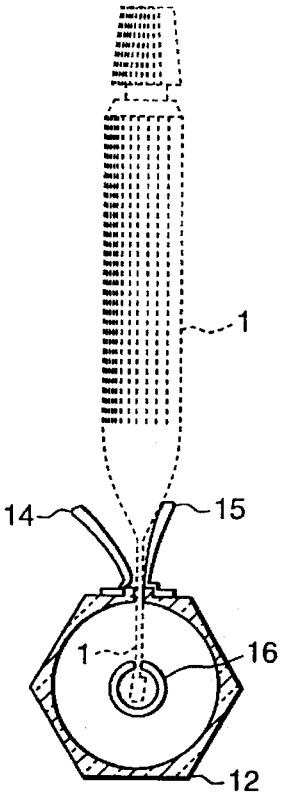
FIGS. 3A, 3B and 3C show side elevational views, partly in cross-section, of the holder shown in FIG. 1.
Figure 3B:
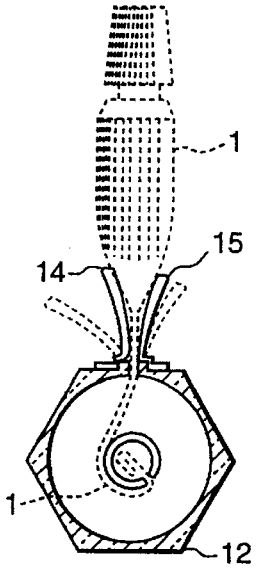
Figure 3C:
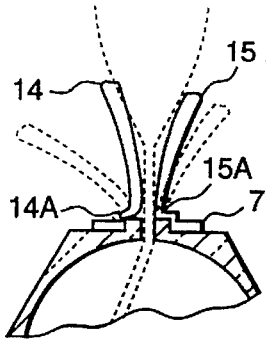

FIGS. 3A, 3B and 3C show side elevations of the holder shown in FIG. 1. FIG. 3A shows a soft tube 1 containing jell or paste-like material installed in the squeezing holder 10. The soft tube 1 is a tube made of material that can be flattened and wound up, such as soft metal or plastic. When the tube 1 is being installed, flanges 14 and 15 are set aside to easily install tube 1 into the longitudinal slot 2 of the main housing 12, as better seen with the dotted lines in FIG. 3C. Then, flanges 14 and 15 are returned to their original positions, as seen with the solid lines in FIG. 3C. The flange 14 is allowed to open or close by hinging at location 14A, therefore, when the flange 14 is open, it allows a bigger opening along the slot 2; and when it is closed in, the face of the flange 14 is positioned beyond the face of the slot, thus leaving a space smaller than the slot 2 for more flattened and efficiently squeezing. Similarly, the flange 15 is allowed to be hinged at location 15A, a location closer to the opening slot 2, thus providing a stiffer surface to be pressed against the flange 14. FIG. 3B shows the tube 1 after some of the material has been squeezed out of the tube 1 and shows the empty flattened portion of the tube wound into the main housing 12.

Figure 4:
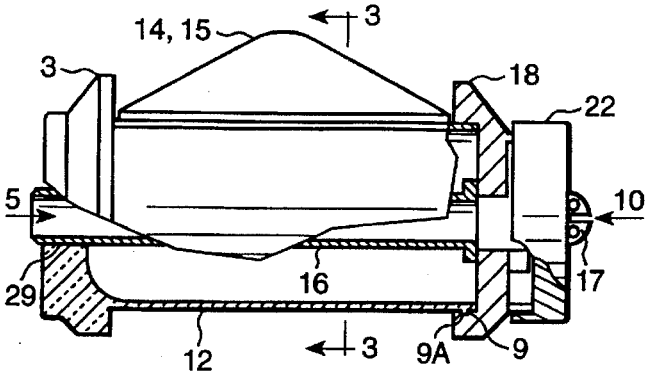
FIG. 4 is a partial cross-sectional view of a side elevation of the assembled holder shown in FIG. 1.

FIG. 4 illustrates a partial cross-section of a side elevation of the assembled holder 10. The center tube gripper 16 is received orthogonally by the main housing 12. The end cap 3 has a center aperture 29 for receiving a first end of the center tube gripper 16. The second end of the center tube gripper 16 has a shaped key section 17. The key section 17 is orthogonally received by the cover 18 and the rotation handle 22. The protrusions 9 are formed on the surface of the main housing 12, which engage with the complimentary notches 9A formed at the recessed face of the cover 18, to firmly secure the cover 18 with the main house 12.

Figure 5:
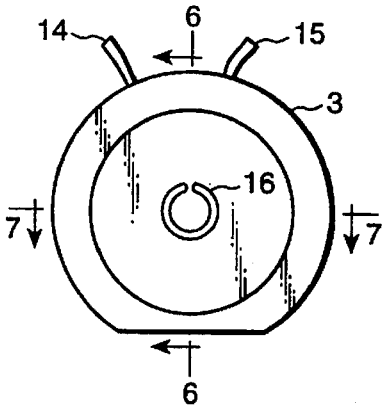
FIG. 5 is an end view of the holder of FIG. 4, taken in the direction of arrow 5 shown in FIG. 4.

FIG. 5 shows an end view of FIG. 4, in the direction of arrow 5. The center tube gripper 16 is received by the end cap 3.

Figure 6:
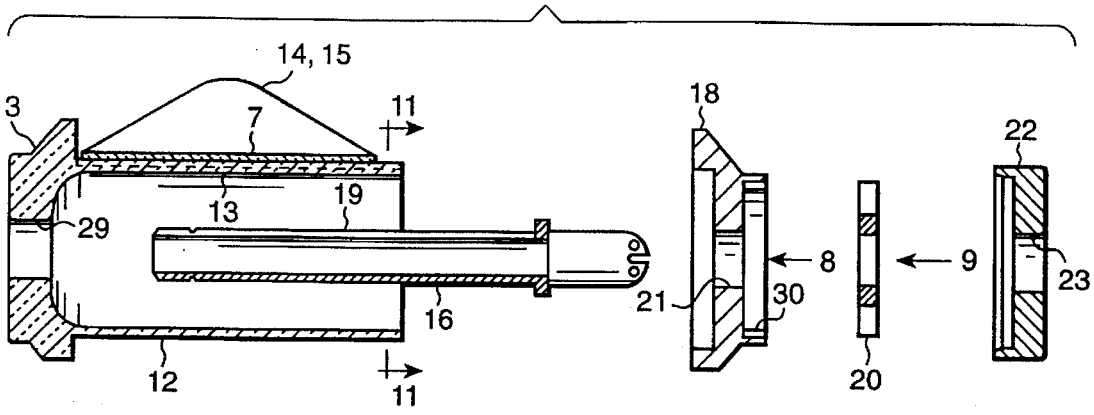
FIG. 6 is an exploded sectional view showing each component of the holder of FIGS. 1 and 2, taken in the direction of arrow 6 in FIG. 5.
Figure 7:
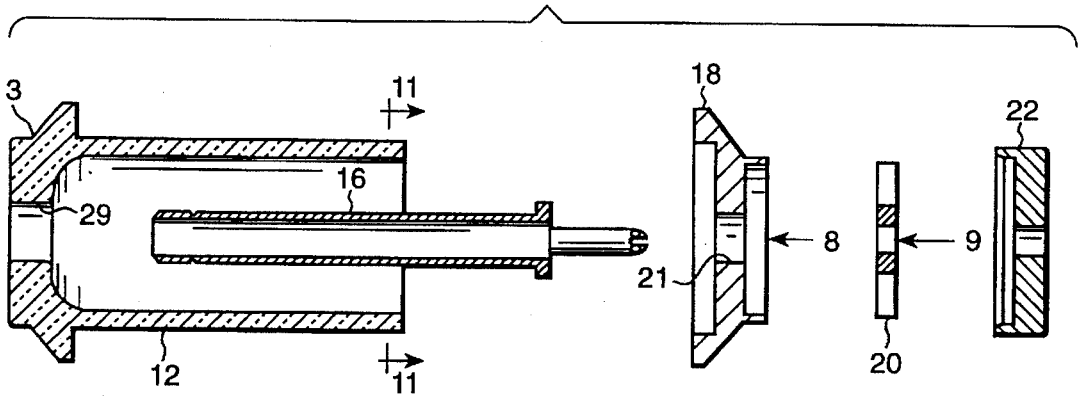
FIG. 7 is an exploded sectional view showing each component of the holder of FIGS. 1 and 2, taken in the direction of arrow 7 in FIG. 5.

FIGS. 6 and 7 illustrate each component of the invention in a sectional view taken in the direction of arrows 6 and 7, respectively shown in FIG. 5. To install a tube 1 into the squeezing holder 10, first the components of the holder 10 are disassembled. There are five parts for the entire assembly. FIGS. 6 and 7 show two sectional views from two orthogonal directions for each of these five parts. To assemble the holder 10 from the parts shown, for use, slide a tube 1(not shown) into the longitudinal slot 19 of the center tube gripper 16, align the longitudinal slot 2 of the main housing 12 and the slot 19 of center tube gripper 16, then insert the center tube gripper 16 into the main housing 12 until the end of the center tube gripper 16 is locked into the center aperture 29 of the end cap 3. The cover 18 receives the one-way-rotation disc 20 and the rotation handle 22 can then be installed, in that order. The cover 18 will lock onto the main housing 12, and the rotation handle 22 will snap onto the end of center tube gripper 16, through the shaped hole 23, to complete the entire assembly.

Figure 8:
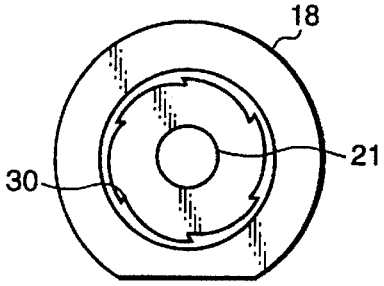
FIG. 8 is an end view of a cover formed with fixed teeth, taken in a direction of arrow 8 in FIGS. 6 and 7.
Figure 9:
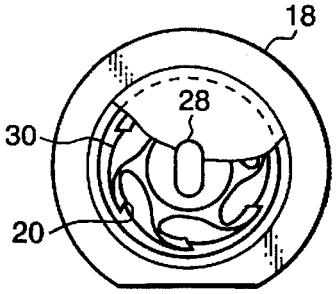
FIG. 9 is a partially cut away elevational view of the cover installed with the one-way-rotation disc, taken in a direction of arrow 9 in FIGS. 6 and 7.

As illustrated in FIG. 8 fixed teeth 30 are formed inside the cover 18 to prevent the one-way-rotation disc 20 which is inserted in the cover 18, as shown in FIG. 9, from rotating in the reverse direction. A round opening hole 21 in the center of the cover 18 allows the center tube gripper 16, the one-way-rotation disc 20 and the rotation handle 22 be rotated together.

Figure 10:
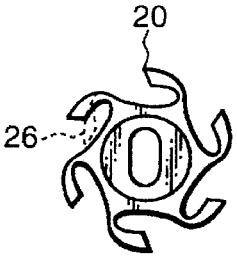
FIG. 10 is an elevational view of a one-way-rotation disc.

As shown in FIGS. 9 and 10, the one-way-rotation disc 20 has multiple flexible teeth that will be deflected (see tooth 26), and slide over the fixed teeth 30 of the cover 18 when the disc 20 is rotated (shown here as rotation in a clockwise direction), thus allowing the center tube gripper 16 to be rotated in that direction only. The flexible teeth will be pushed hard against the fixed teeth 30 on the inside of the cover 18 if rotation of the center tube gripper 16 is attempted in the reverse direction, thus preventing rotation in the reverse direction.

Figure 11:
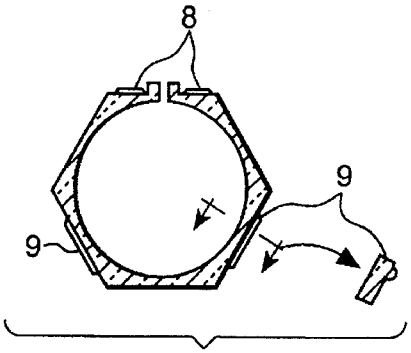
FIG. 11 is a sectional view of the main housing, taken in the direction of arrow 11 in FIGS. 6 and 7, illustrating protrusions formed on surface thereon.

FIG. 11 illustrates protrusions 9 formed on the surface of the main housing 12, which engage with the complementary notches 9A formed at the recessed face of the cover 18 to firmly secure the cover 18 with the main housing 12, better seen in FIG. 2.

Figure 12:
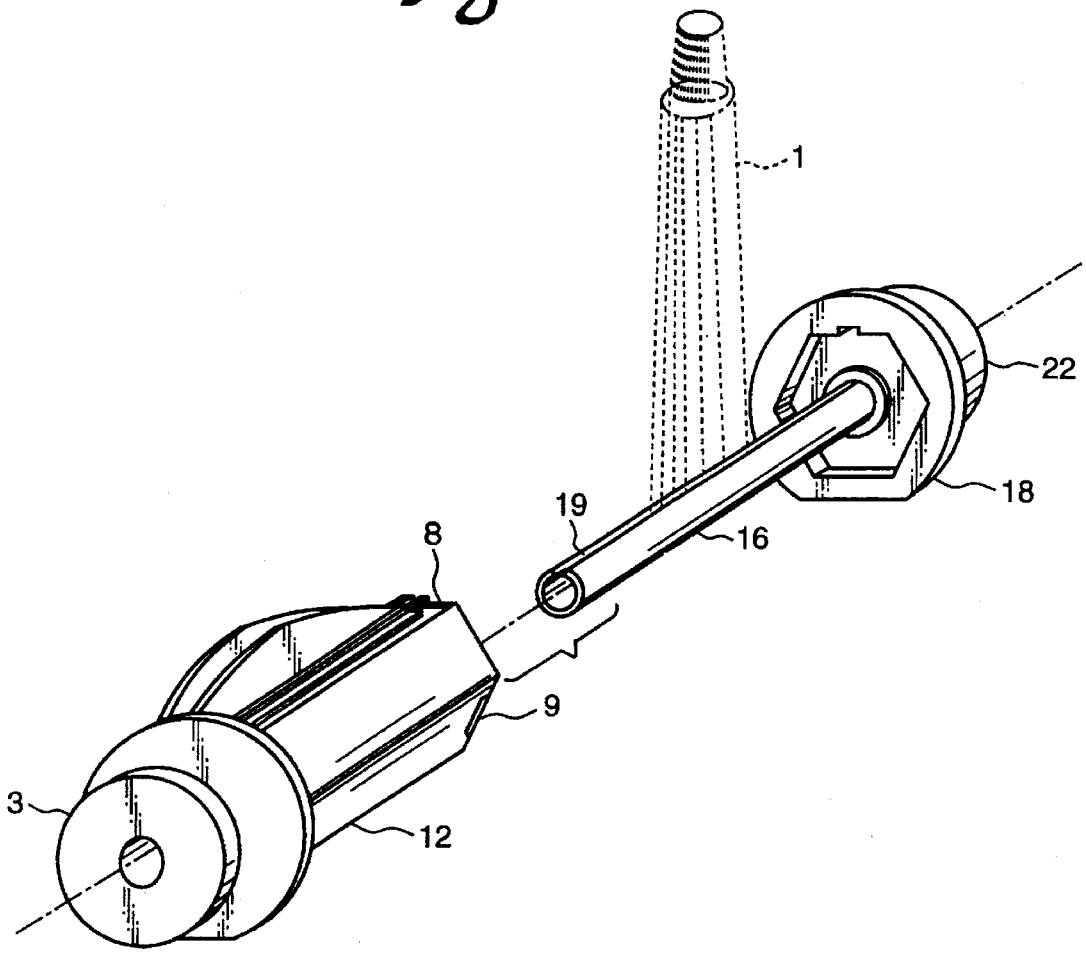
FIG. 12 is an exploded view showing a tube held by the center tube gripper, installed together with the cover and the rotation handle, in relative assembled position with the main housing according to the first embodiment of the present invention.

FIG. 12 illustrates a center tube gripper 16 installed with the cover 18 and the rotation handle 22, and a tube 1 to be flattened is inserted into the longitudinal slot 19 of the center tube gripper 16. The center tube gripper 16 is in relative assembled position with the main housing 12.

Figure 13:
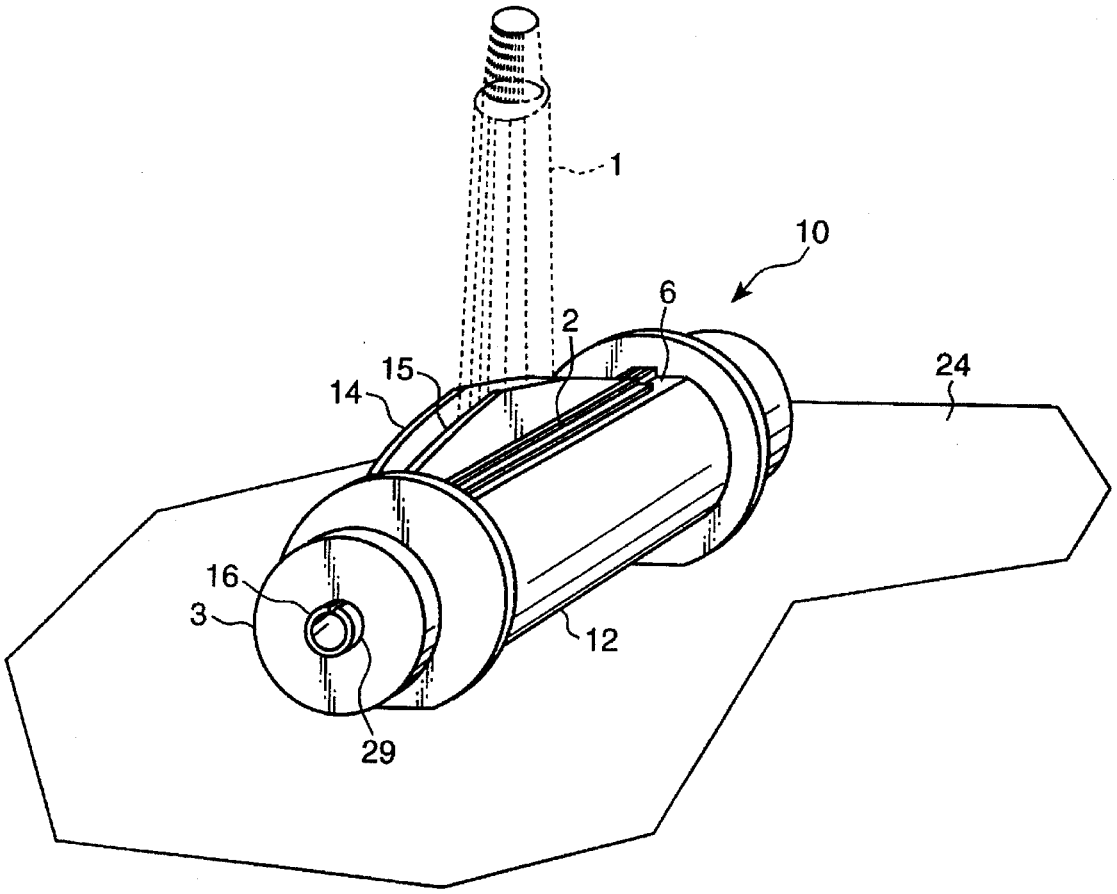
FIG. 13 is a perspective view illustrating a tube inserted into a squeezing holder according to a second embodiment of the present invention.

FIG. 13 illustrates a tube 1 inserted into a squeezing holder 10 according to a second embodiment of the present invention. In particular, the main housing 12 has a cylindrical external shape.

To use the squeezing holder 10, the user can accomplish this purpose with one hand only. Using a palm of one hand to hold the squeezing holder 10, with the tube 1 installed, the user can use his or her thumb to press one of the two flanges 14 and 15 against the other, as shown in FIG. 3B. When the material has been squeezed out and the tube 1 is flattened enough, the rotation handle 22 can be turned to wind in the flattened tube 1 and store the tube 1 inside the main housing 12 as shown in FIG. 3B. When all the material inside tube 1 is used up, the entire assembly can be disassembled and cleaned. The emptied tube 1 be discarded and the squeezing holder 10 for a tube is ready for the next use.

It will be apparent to those skilled in the art that various modifications and variations can be made in the squeezing holder of the present invention without departing from the spirit or scope of the invention. Thus, it is intended that the present invention cover the modifications and variations of this invention within the scope of the appended claims and their equivalents.

What I claim is:

1. A holder for squeezing a soft tube comprising:

a main housing having a longitudinal slot and a hollow interior;

an elongated center tube gripper having a first end, a second end and a longitudinal slot for receiving a closed end of a soft tube and being received at said first end by said main housing and having a key section at said second end;

a cover being assembled with said main housing at a first end of said housing and having a plurality of fixed teeth, said cover receiving said key section of said center tube gripper; and rotating means for rotating said center tube gripper so that the soft tube inserted into said longitudinal slot of said center tube gripper is wound thereon, whereby a flattened wound portion of the soft tube is stored inside of the main housing, said rotating means further comprising:

a rotation handle for manually rotating said center tube gripper, said rotation handle receiving said key section of said center tube gripper; and a one-way-rotation disc placed inside said cover, having a plurality of flexible teeth, and receiving said key section of said center tube gripper through a central aperture thereof, wherein said plurality of flexible teeth deflect and slide over said plurality of fixed teeth when said center tube gripper is rotated in one direction only and, when the center tube gripper is rotated in an opposite direction, the flexible teeth cooperate with the fixed teeth to prevent said center tube gripper from unwinding the tube therefrom.

2. A holder according to claim 1, wherein said main housing further comprises an end cap attached to a second end of said main housing, said end cap having at least one flat side to prevent the holder from rolling, said end cap further comprising an appeture for receiving said first end of said center tube gripper for stabilizing the holder.

3. A holder according to claim 1, wherein the main housing has a hexagonal external shape.

4. A squeezing holder according to claim 1, wherein the main housing has a cylindrical external shape.

5. A holder according to claim 1, wherein said main housing further comprises a pair of flanges for guiding and pressing the tube when the tube is wound inside the main housing.

6. A holder according to claim 1, wherein said rotation handle comprises a knurled outer surface which provides a friction surface for efficiently rotating said rotation handle.

7. A holder according to claim 1, wherein said main housing comprises transparent material for facilitating identification of a label on the tube.

8. A holder according to claim 1, wherein the hollow interior of the main housing is cylindrical.

9. A holder according to claim 1, wherein an edge along the longitudinal slot is thickened to strengthen the main housing.

10. A holder according to claim 1, wherein the flanges are moved to a second position when installing the tube, the flanges are restored to a first position after installing the tube.

11. A holder according to claim 1, wherein at least one protrusion is formed on the surface of the main housing and at least one complementary notch is formed at a recessed face of the cover, thereby said at least one protrusion and said complementary notch engage to firmly secure the cover with the main housing.

* * * * *